United States Patent [19]

Spranza, III

[11] Patent Number: 4,579,311

[45] Date of Patent: Apr. 1, 1986

[54] EQUIPMENT LOCKDOWN APPARATUS

[76] Inventor: Joseph J. Spranza, III, 121 Phillips La., Woodside, Calif. 94062

[21] Appl. No.: 552,266

[22] Filed: Nov. 16, 1983

[51] Int. Cl.[4] ..... A47B 91/00; A47B 95/00

[52] U.S. Cl. ..... 248/553; 70/58; 70/DIG. 57; 108/94; 211/133; 211/144; 248/349

[58] Field of Search ..... 70/58, 62, DIG. 57; 108/92, 94, 101; 211/4, 8, 131, 133, 163, 144; 248/551-553, 349

[56] References Cited

U.S. PATENT DOCUMENTS

| | | | |
|---|---|---|---|
| 37,070 | 12/1862 | Crawford | 108/94 |
| 340,921 | 4/1886 | Newton | 108/94 |
| 2,689,050 | 9/1954 | Albin | 108/101 |
| 3,664,616 | 5/1972 | Raskin | 70/58 X |
| 3,913,880 | 10/1975 | Lucasey et al. | 248/553 X |
| 4,007,613 | 2/1977 | Gassaway | 70/DIG. 57 X |
| 4,024,737 | 5/1977 | McInturff | 70/58 |
| 4,079,604 | 3/1978 | Anderegg | 70/58 |
| 4,305,563 | 12/1981 | Presson | 248/349 |
| 4,353,521 | 10/1982 | Webb | 70/58 X |

*Primary Examiner*—Kenneth J. Dorner
*Assistant Examiner*—Russell W. Illich
*Attorney, Agent, or Firm*—Paul B. Fihe

[57] ABSTRACT

An equipment lockdown apparatus for locking pieces of equipment such as computer modules, typewriters or the like is disclosed. The apparatus includes a sub-base suitably secured to a desk or other supporting structure and which supports the remainder of the unit for rotation. A base shelf is included together with a pedestal which rotatably supports thereon one or more additional shelves for rotation. Shields are positioned adjacent each shelf to preclude access to fastening elements for the pieces of equipment on each shelf and a key-controlled locking mechanism holds the entire unit in assembled relation thus precluding access to the fastening means whereby the pieces of equipment are securely locked.

11 Claims, 3 Drawing Figures

EQUIPMENT LOCKDOWN APPARATUS

FIELD OF THE INVENTION

The present invention relates generally to locking devices, and more particularly, to lockdown apparatus for securing computer modules, typewriters or other portable equipment to a mounting structure such as a desk.

BACKGROUND OF THE INVENTION

Since many pieces of equipment such as computer terminals, typewriters and the like are relatively expensive and readily portable, theft is a considerable problem.

As a consequence, some locking or security devices have been proposed but are limited in many ways. For example, provision for the locking of several associated modules, (e.g. computer keyboard, disc drives, CRT display) are not conveniently locked in position. Service access is also restricted, and installation as well as user accessibility are difficult.

SUMMARY OF THE PRESENT INVENTION

Accordingly, it is the general objective of the present invention to provide equipment lockdown apparatus capable of securing a number of associated pieces of equipment (e.g. computer modules) in a useable configuration with permitted pivoting for use and/or servicing yet providing theft or tamper-proof locking with a single locking mechanism.

To achieve such objective, the apparatus includes a sub-base in the form of a flat plate which can be secured by screws or other means to a mounting structure such as a desk.

A spindle is secured centrally to the sub-base and projects a slight distance upwardly to rotatably support a base shield also in the form of a plate. The upper surface of the base shield mounts four notched keepers enabling lateral reception of feet formed by nuts on the lower ends of four bolts welded to a base shelf having a down-turned peripheral flange which encompasses both the shield and sub-base when the base shelf is mounted, thus precluding access to the interior fastening and connecting members.

One piece of equipment can be placed on top of the base shelf and typically has threaded sockets into which machine screws can be screwed upwardly through registering holes in the base shelf. Thus, the heads of such screws are enclosed within the base shelf so as to be inaccessible.

A lateral projection on the base shelf mounts an upstanding hollow pedestal of cylindrical form to enable mounting of one or more additional shelves, for rotative support of additional pieces of equipment on the pedestal. Collars between the shelves on the pedestal maintain appropriate spacing to accommodate the equipment units and fastening means such as screws project upwardly through holes in such shelves to mount the equipment thereon. The heads of such screws are covered by shields which can slide into peripheral flanges on the shelves to preclude access to the mounting screws and removal of the equipment.

The entire assembly is locked in its closed inaccessible position by a locking rod that projects downwardly through the hollow pedestal for threaded connection in a threaded socket in the lowermost or base shield. A key lock at the upper exposed end of the locking rod precludes turning thereof unless the appropriate key is inserted into the lock.

While the assembly can not be removed without unlocking the described mechanism, it will be noted that the entire assembly can be rotated on the sub-base and the individual shelves can be rotated on the pedestal to provide the desired positions for use or servicing of the equipment without unlocking the same.

BRIEF DESCRIPTION OF THE DRAWING

The stated objective of the invention and the manner in which it is achieved, as summarized above, will be more fully understood by reference to the following detailed description of the exemplary embodiment of the invention shown in the accompanying drawing wherein.

DETAILED DESCRIPTION OF THE EXEMPLARY EMBODIMENT OF THE INVENTION

Figures 1, 2, 3:
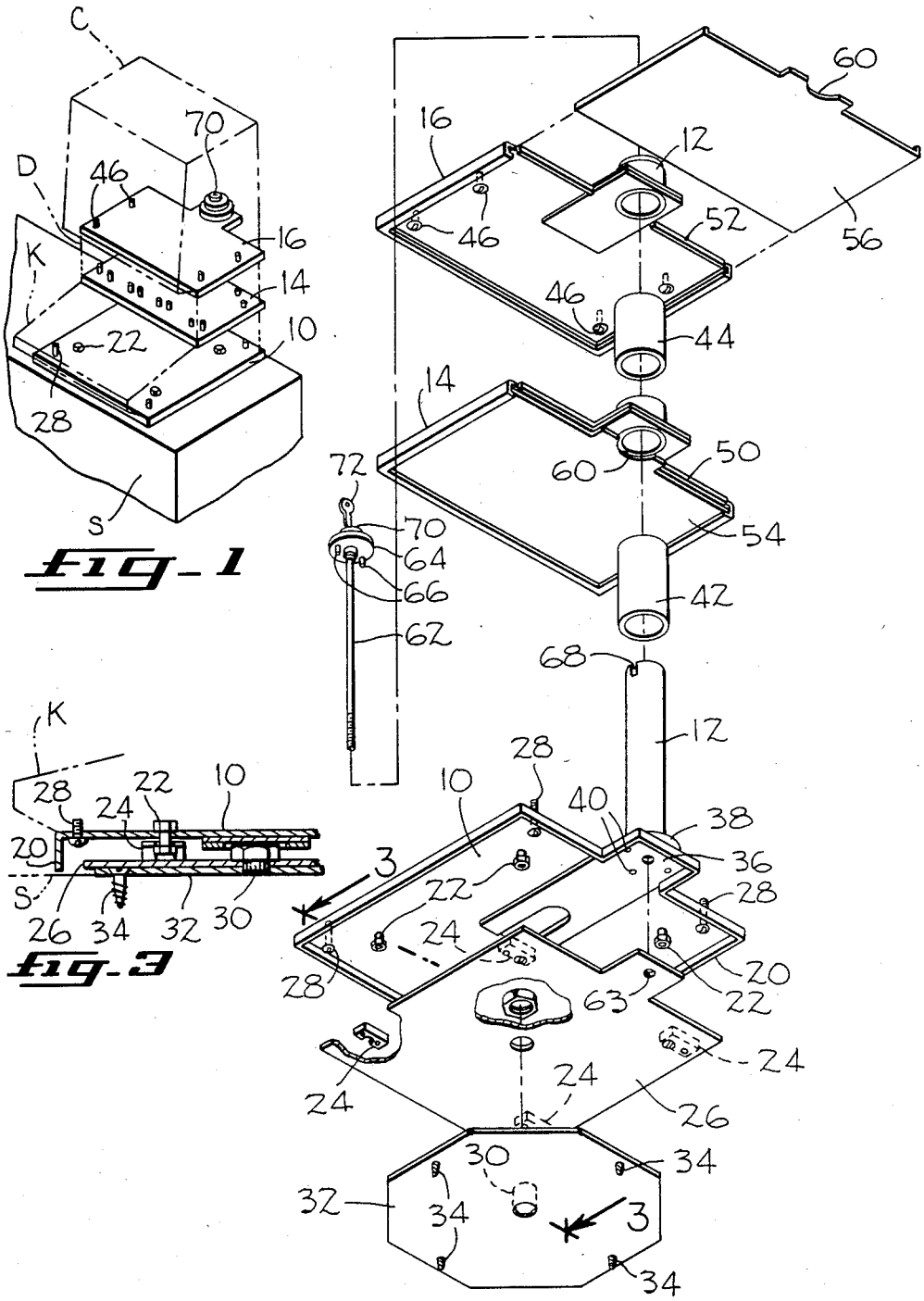
FIG. 1 is a perspective view of the equipment lockdown apparatus supporting equipment shown in phantom lines on a desk.
FIG. 2 is an exploded perspective view of the FIG. 1 apparatus.
FIG. 3 is a broken sectional view taken along line 3—3 of FIG. 2 showing certain structural details.

With initial reference to FIG. 1, the illustrated equipment lockdown apparatus includes a lower or base shelf 10 supported for rotation immediately above a desk or other relatively large and heavy supporting structure S. A pedestal 12 rises from one side of the base shelf 10 and rotatably supports two additional shelves 14, 16 at vertically-spaced intervals. As will be described in detail hereinafter, the shelves 10, 14, 16 are spaced and dimensioned to mount several pieces of equipment indicated in phantom lines in FIG. 1. For example, the base shelf 10 might support a computer keyboard module K, the second shelf 14 could support a disc drive D and the upper shelf 16 a CRT display C, although other pieces of equipment requiring lockdown can also be readily accommodated by mere change in shelf demensions or spacing.

With additional reference to FIGS. 2 and 3, the base shelf 10 is basically in the form of a flat metal plate with downturned peripheral flanges 20 whose lower edges lie closely adjacent the supporting structure S. Nuts 22 are secured at the lower extremities of bolts which are, in turn, welded in openings in the base shelf. These nuts 22 form feet which can be laterally inserted into notched keepers 24 secured to the top of a base shield 26 within the confines of the outer base shelf flanges 20. Holes are formed through the base shelf 10 at appropriate position so that fastening means here shown as machine screws 28 can project upwardly through the holes for screwed insertion into the bottom of the keyboard module K to secure the same on the base shelf 10. When the base shield 26 is in position as described, it will be apparent that the heads of the machine screws 28 are inaccessible and thus the keyboard module K can not be detached from the mounting base shelf 10.

The base shield 26 is, in turn, mounted for rotation about a spindle 30 which rises centrally from a sub-base 32 which is itself secured as by wood screws 34 or other means to the underlying supporting structure. The shield 26 also precludes access to these mounting screws 34.

A lateral projection 36 on the base shelf 10 mounts the mentioned pedestal 12 to rise therefrom. More particularly, the pedestal is a hollow cylindrical structure having a circumferential flange 38 at its lower end. The flange 38 has four threaded holes that receive four machine screws 40 whose heads lie under the base shelf 10 and closely adjacent corresponding lateral projection on the base shield 26 thus to again preclude access to the heads of the machine screws 40 when the structure is assembled.

The pedestal 12 rotatably mounts the additional shelves 14, 16 which have openings that loosely surround the pedestal.

Collars 42, 44 surround the pedestal 12 and hold the shelves 14, 16 in desired spaced vertical relation to accommodate the disc drives D and CRT display C.

Like the base shelf 10, these additional shelves 12, 14 have appropriately positioned holes 46 which allow machine screws 48 or other fastening means to project upwardly for threaded and holding insertion into the equipment supported thereon.

To preclude access to these mounting screws 48, the shelves 14, 16 each have down and inturned peripheral flanges 50, 52 on three sides enabling lateral sliding entry of shields 54, 56 from the position shown at the top of FIG. 2 to the shielding position shown at the middle of that Figure. Curved notches 58, 60 at one side of the shields 54, 56 engage the side of the pedestal 12 to preclude removal of the shields when the unit is assembled.

To hold the structure in its assembled disposition, a locking rod 62 extends axially downwardly through the hollow pedestal 12 for passage through a hole in the base shelf lateral projection 36 and for threaded connection in an aligned threaded hole 63 in the base shield 26 thereunder. The top of the locking rod 62 mounts a lateral flange 64 having two projections 66 which are received in notches 68 on top of the pedestal. When so positioned, a locking unit 70 on top of the rod 62 can receive a key 72 to lock or unlock the entire assembly as desired. When locked, access to all connecting screws or other interior elements is positively precluded, but the entire assembly can be pivoted about the sub-base spindle 30, and the upper shelves 14, 16 can be pivoted about the pedestal, thus to allow desired dispositions for use or service access.

Obviously, a simple change of the pedestal length and of the collars 42, 44 can enable other shelves to be assembled to accommodate other equipment on the same basic structure.

Various other modification, and/or alterations can obviously be made without departing from the spirit of the invention and the foregoing description is not to be considered in a limiting sense, and the actual scope of the invention is to be indicated only by the appended claims.

What is claimed is:

1. Equipment lockdown apparatus which comprises a bus-base, first fastening means adapted to secure said sub-base to a mounting structure such as a desk, a base shield mounted on said sub-base, a base shelf having a peripheral flange encompassing said sub-base and said shield to preclude access to said first fastening means, second fastening means on said base shelf adapted to secure a piece of equipment thereto, said base shield precluding access to said second fastening means, at least one additional shelf supported above said base shelf, additional fastening means on each of said additional shelves adapted to secure additional pieces of equipment on said additional shelves, additional shields releasably connected to each of said additional shelves to preclude access to said additional fastening means, and means for locking said shelves and shields in access-precluding positions.

2. Equipment lockdown apparatus according to claim 1 wherein said base shield is mounted for rotation on said sub-base.

3. Equipment lockdown apparatus according to claim 1 wherein said additional shelves are supported for rotation relative to said base shelf.

4. Equipment lockdown apparatus according to claim 1 which comprises means releasably securing said base shield to the interior of said base shelf.

5. Equipment lockdown apparatus according to claim 4 wherein said locking means includes a locking rod threaded at its end for screwed insertion into a threaded opening in said base shield.

6. Equipment lockdown apparatus according to claim 5 wherein said locking means is arranged to lock said locking rod in its shield-inserted position.

7. Equipment lockdown apparatus according to claim 1 which comprises a pedestal secured to said base shelf to rise substantially vertically therefrom, and said additional shelves being supported for rotation on said pedestal.

8. Equipment lockdown apparatus according to claim 7 which comprises collars surrounding said pedestal and arranged to hold said additional shelves in spaced relation.

9. Equipment lockdown apparatus according to claim 8 wherein said pedestal is hollow, and said locking means includes a locking rod extending the length of said pedestal for screwed connection at its lower end to said base shield.

10. Equipment lockdown apparatus according to claim 9 wherein said locking means includes a key lock at the top of said locking rod for locking said rod in its connected position.

11. Equipment locking apparatus according to claim 7 wherein said pedestal engages the sides of said additional shields to hold the same in position adjacent said additional shelves.

* * * * *